US007075500B2

(12) United States Patent
Carbonari

(10) Patent No.: US 7,075,500 B2
(45) Date of Patent: Jul. 11, 2006

(54) ANTENNA FOR WIRELESS KVM, AND HOUSING THEREFOR

(75) Inventor: David Carbonari, Murrieta, CA (US)

(73) Assignee: Avocent California Corporation, Escondido, CA (US)

( * ) Notice: Subject to any disclaimer, the term of this patent is extended or adjusted under 35 U.S.C. 154(b) by 0 days.

(21) Appl. No.: 10/948,307

(22) Filed: Sep. 24, 2004

(65) Prior Publication Data

US 2006/0066500 A1 Mar. 30, 2006

(51) Int. Cl.
*H01Q 1/36* (2006.01)

(52) U.S. Cl. ..... 343/895; 343/700 MS

(58) Field of Classification Search ..... 343/700 MS, 343/702, 895

See application file for complete search history.

(56) References Cited

U.S. PATENT DOCUMENTS 3,925,784 A * 12/1975 Phelan ..... 343/754
5,589,842 A * 12/1996 Wang et al. ..... 343/787
6,130,652 A * 10/2000 Goetz et al. ..... 343/895
6,765,542 B1 * 7/2004 McCarthy et al. ..... 343/895
6,778,149 B1 8/2004 Fukae et al. ..... 343/895
6,864,856 B1 * 3/2005 Lynch et al. ..... 343/895

OTHER PUBLICATIONS

PCT International Search Report mailed Dec. 5, 2005 in corresponding PCT application No. PCT/US2005/034327.

* cited by examiner

*Primary Examiner*—Shih-Chao Chen
(74) *Attorney, Agent, or Firm*—Davidson Berquist Jackson & Gowdey, LLP

(57) ABSTRACT

An antenna apparatus includes a spiral metallic pattern formed on a portion of a circuit board on a first side thereof, the spiral pattern being formed of four arms, each arm having a contact location near the center of the spiral; a plurality of pin and ground connectors attached to a second side of said circuit board and electrically connected to the ones of the spiral arms at the contact locations thereof, said pins being connected to said arms via holes in said circuit board.

20 Claims, 26 Drawing Sheets

Remote

Remote

Remote

Remote

Remote

Remote

Remote

Local

Local

Local

Local

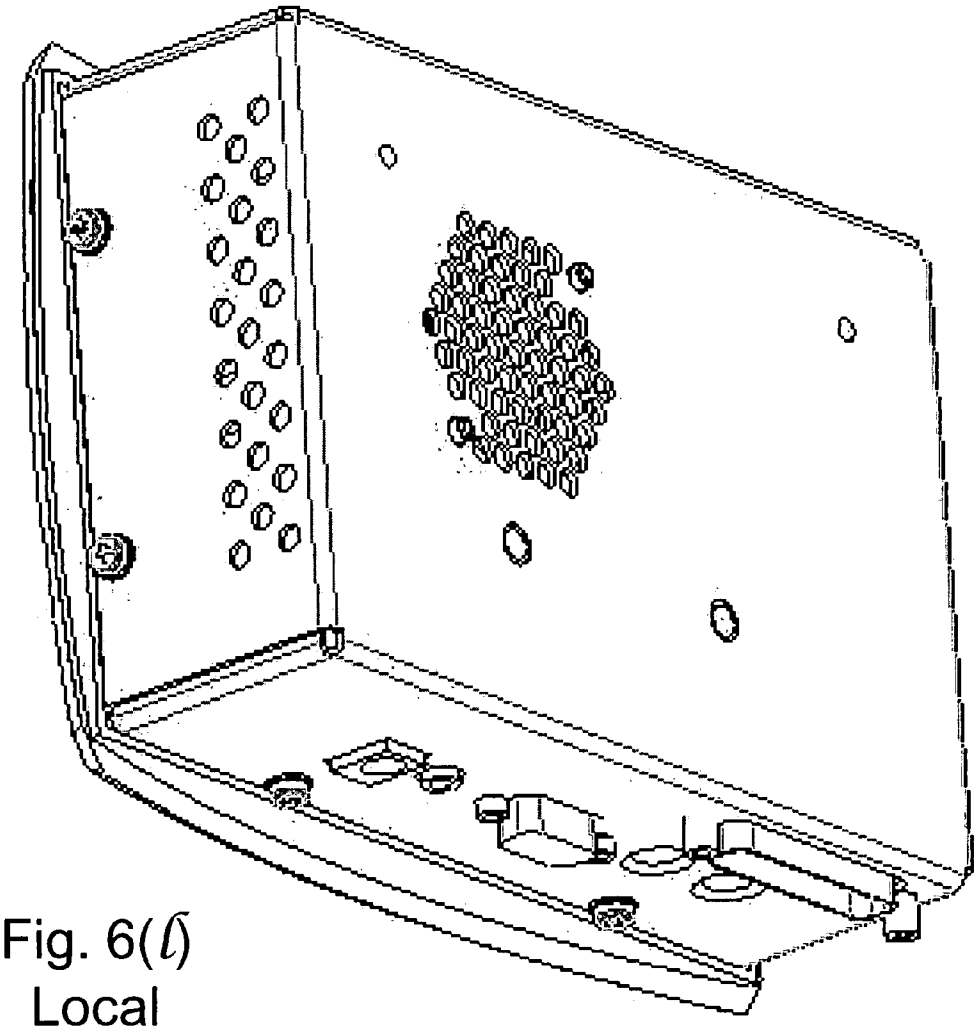
Fig. 6(*l*)
Local

Local

Local

ANTENNA FOR WIRELESS KVM, AND HOUSING THEREFOR

FIELD OF THE INVENTION

This relates antennas, and, more specifically, to antennas for use in with KVM (Keyboard, Video, Mouse) systems.

BACKGROUND & SUMMARY

KVM systems enable one or more remote computers to access and/or control one or more target computers. The term computer as used herein is non-limiting and refers to any processor or collection of processors, including servers (and groups or racks thereof), processors in appliances such as ATM machines, kiosks, cash registers, set-top boxes, PCs and the like. Early KVM systems used wired connections between the remote and target computers. However, more recently, wireless KVM systems have become available, e.g., from Avocent Corporation, the assignee of the present application.

A typical wireless KVM system connecting a target computer to a remote computer uses two radios, one at the target computer (or at a switch connected thereto) and the other at the remote computer. These systems preferably operate using the 802.11a standard. Prior wireless KVM systems used two omni-directional antennas. However, using this type of antenna limited the range of transmission between the two radios (the wireless transmitter and the wireless receiver) to about 100 feet through three walls and up to 300 feet line-of-sight. Notably, the distance range was limited by the antennas used, and not by issues relating to the 802.11a standard. It is desirable and an object of the present invention to extend the distance between the wireless radios (the Transmitter and the Receiver) in a KVM system, especially 802.11a-based wireless systems.

This invention provides 802.11 a radios an efficient, circularly polarized directional antenna.

It is a further object of the present invention that the transmitted and received signal modulation should not be distorted or sacrificed in group delay. Accordingly, a type of frequency independent structure that includes a match of 50 ohms across the operating bandwidth was developed and optimized.

DESCRIPTION OF PRESENTLY PREFERRED EXEMPLARY EMBODIMENTS

Figure 1:
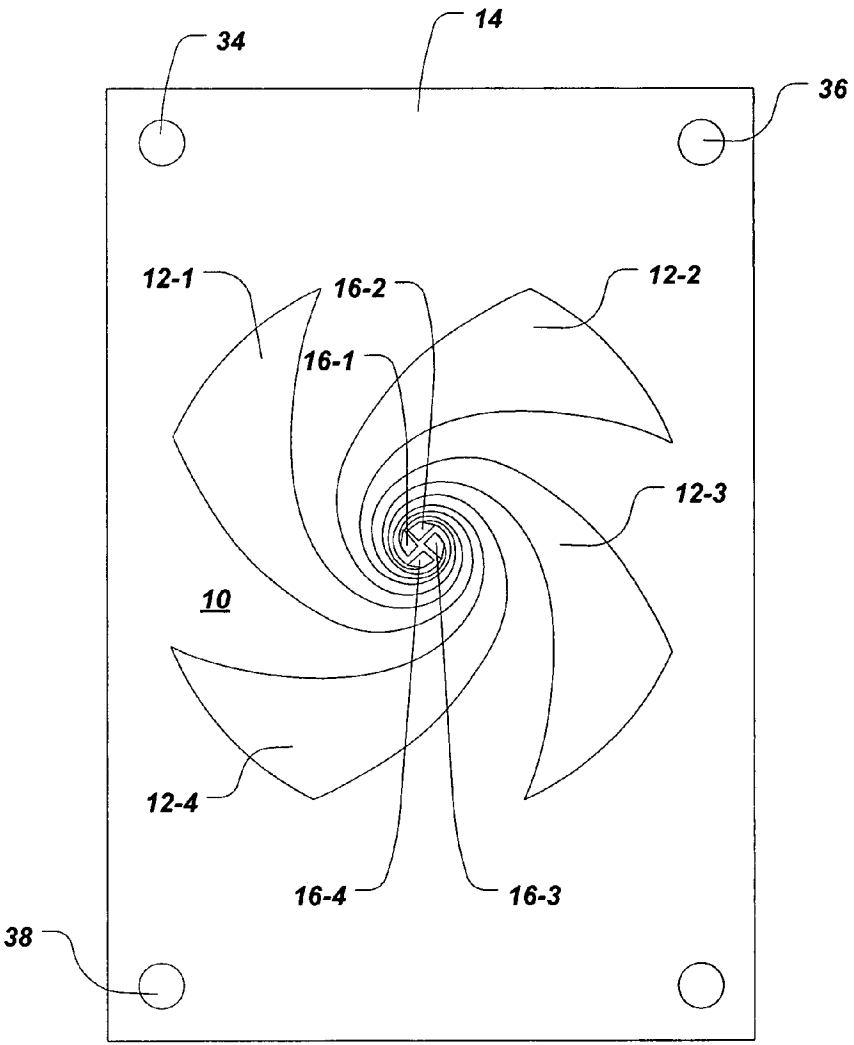
FIG. 1 shows an antenna according to embodiments of the present invention, positioned on a printed circuit board.

With reference to FIG. 1, an antenna according to embodiments of the present invention, comprises a circularly polarized spiral antenna 10 formed by a metallic spiral pattern, e.g., on a substrate such as a printed circuit board ("PCB") 12 or the like. The spiral antenna 10 preferably has four arms 12-1, 12-2, 12-3 and 12-4, each of which has a corresponding metallic contact area 16-1, 16-2, 16-3, 16-4 near the center of the spiral. The arms are preferable formed of a conductor (e.g., a metal) on the substrate 12.

Figure 2:
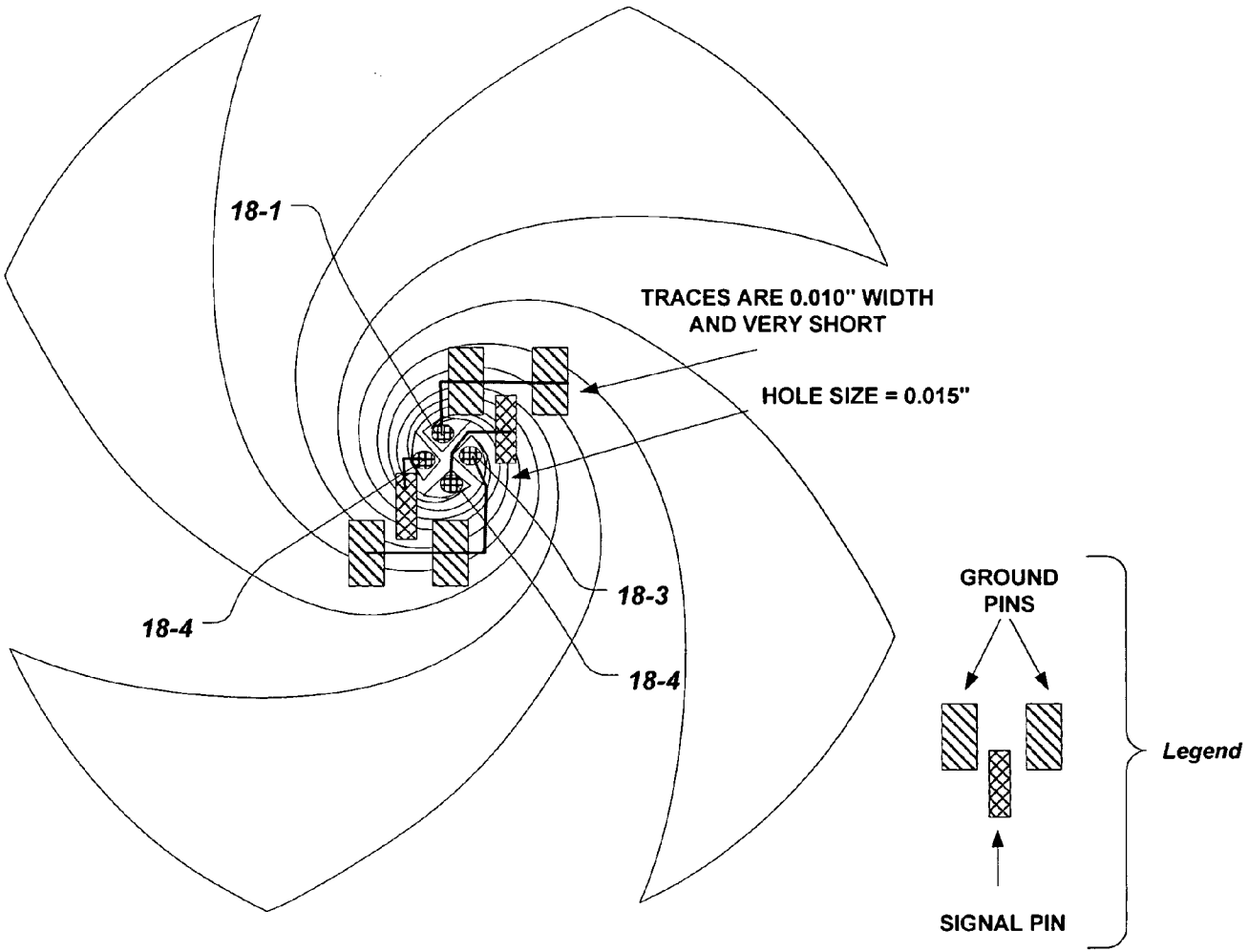
FIGS. 2–3 show aspects of the electrical connectivity of the antenna of FIG. 1.
Figure 3:
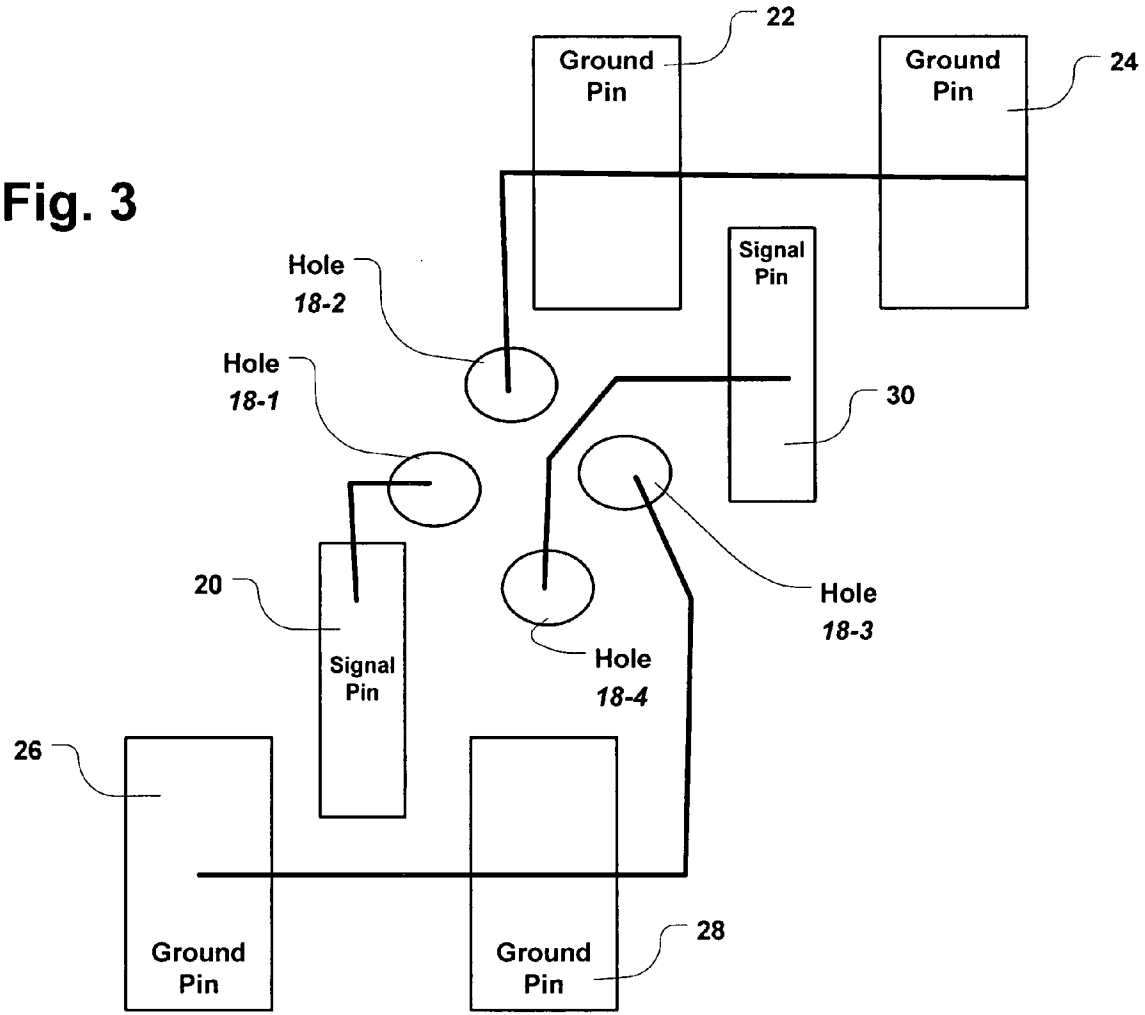

In order to form electrical connections with the antenna 10, when formed on a substrate 12, as shown in FIGS. 2–3, the substrate has four holes 18-1, 18-2, 18-3, 18-4 therein, corresponding in location to be under the contact areas 16-1, 16-2, 16-3, 16-4. Using wires passed through these holes, appropriate electrical contact may be made with each of the four antenna arms, through the substrate 12, to contact pins on the other side of the substrate. The contact pins are either signal or ground pins. In preferred embodiments the holes are about 0.015 inches in diameter and are completely covered by their respective contact areas.

FIG. 3 provides an enlarged view (for explanation purposes) of the contact pins and their connection to the various spiral arms. In particular, in the embodiment shown, spiral arm 12-1 is electrically connected to signal pin 20, spiral arm 12-2 is electrically connected to ground pins 22 and 24; spiral arm 12-3 is electrically connected to ground pins 26 and 28; and spiral arm 12-4 is electrically connected to signal pin 30.

Figure 4A:
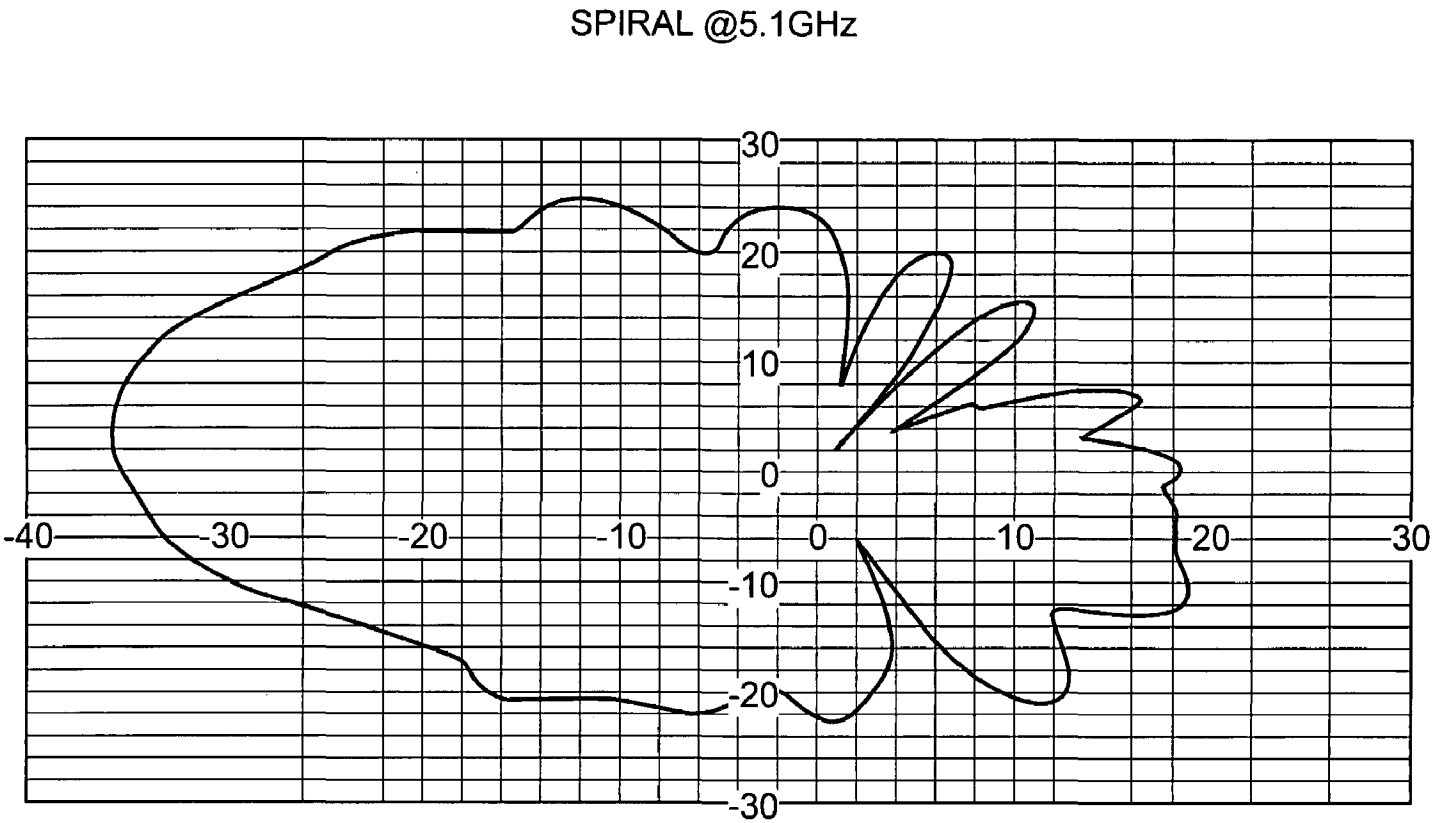
FIGS. 4(*a*)–4(*b*) are graphs showing the performance of the antenna of FIG. 1 at various frequencies.
Figure 4B:
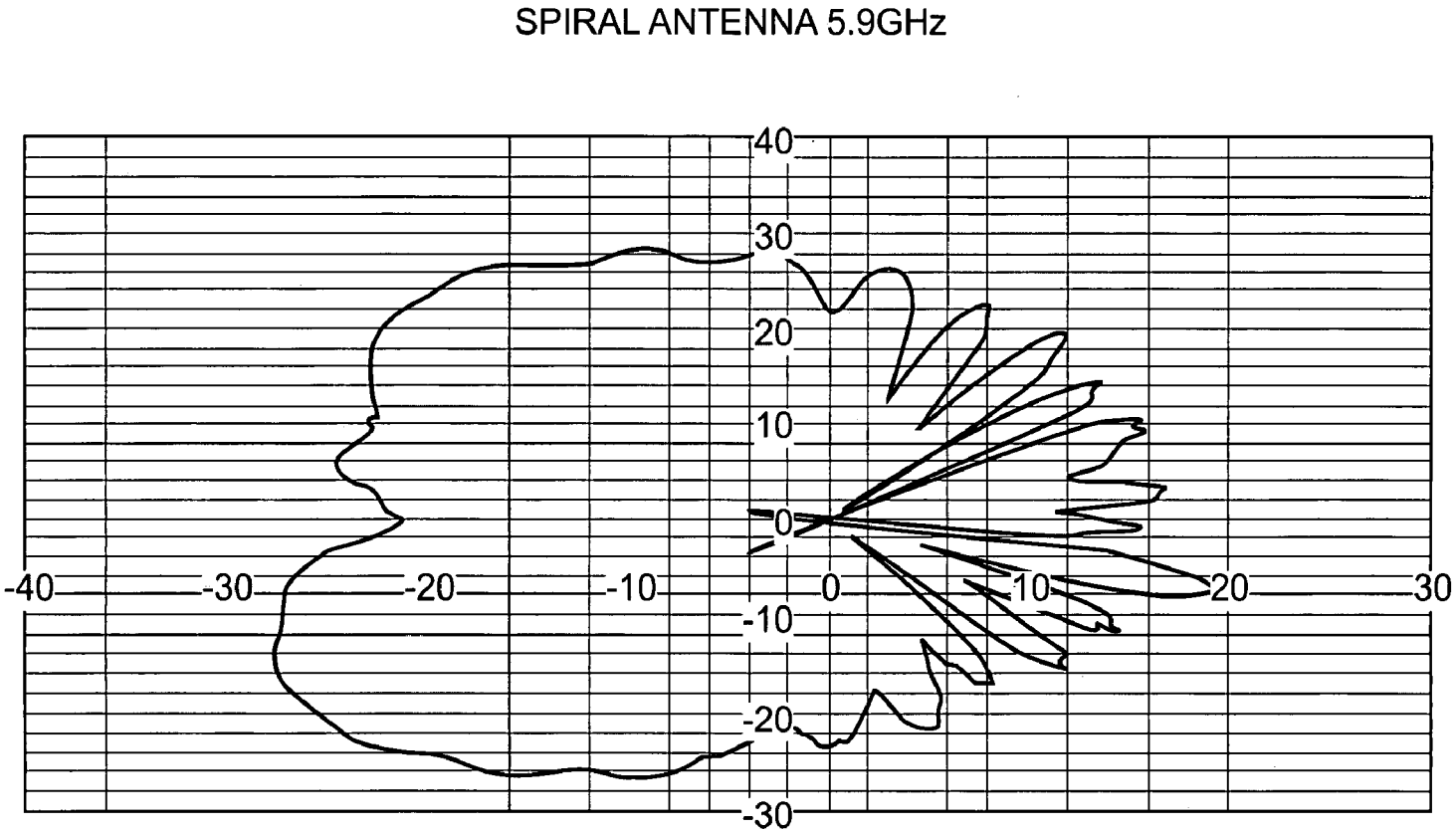
Figure 5A:
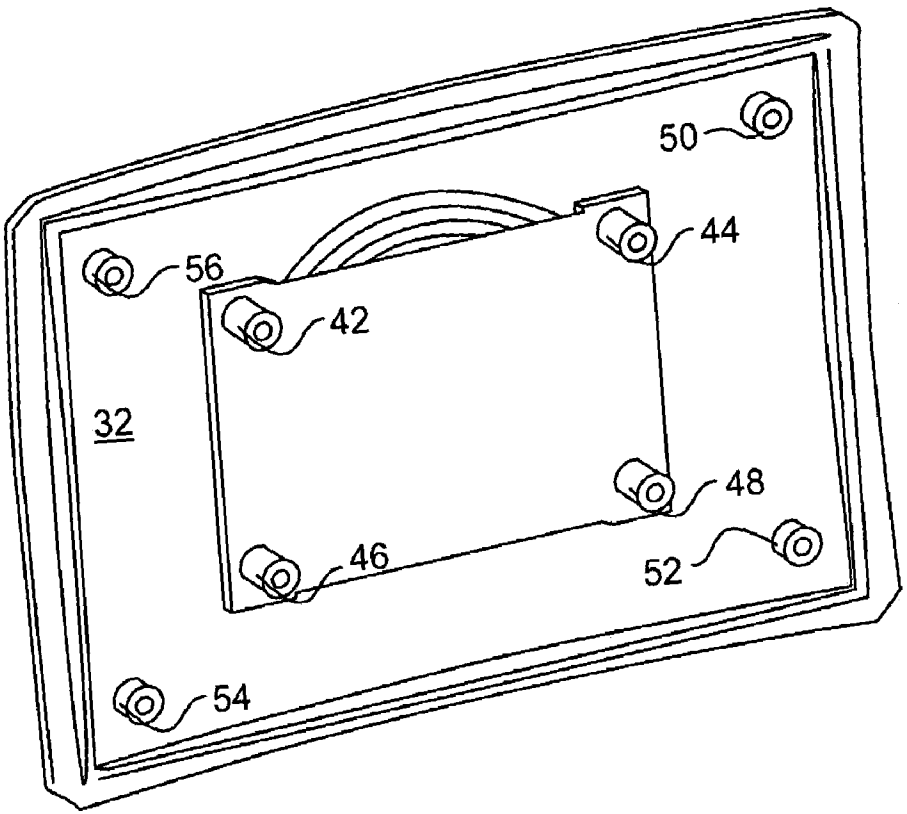
FIGS. 5(*a*)–5(*j*) and 6(*a*)–6(*n*) depict various packaging structures for the antenna of the present invention.
Figure 5B:
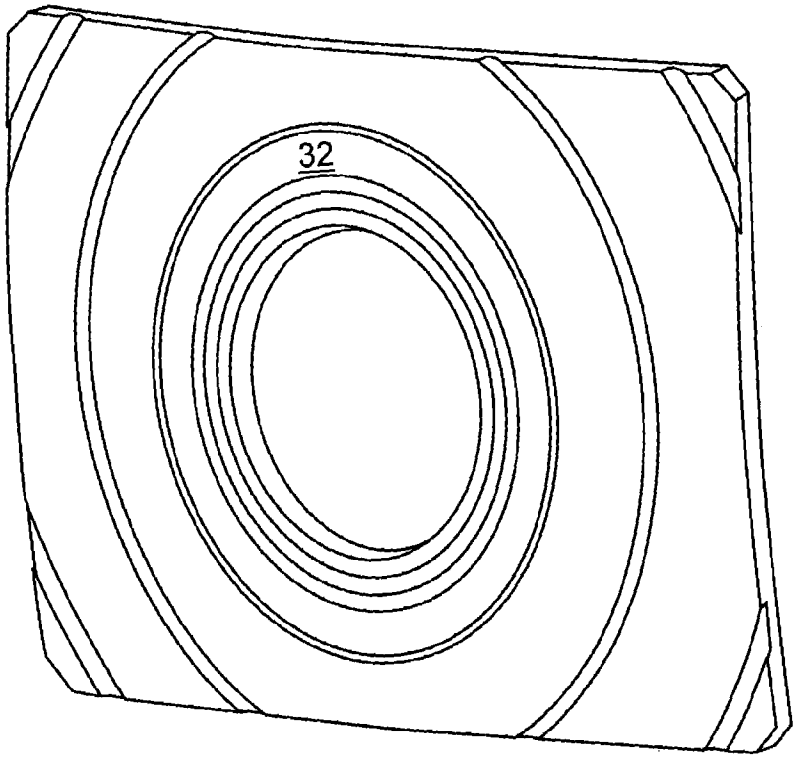
Figure 5C:
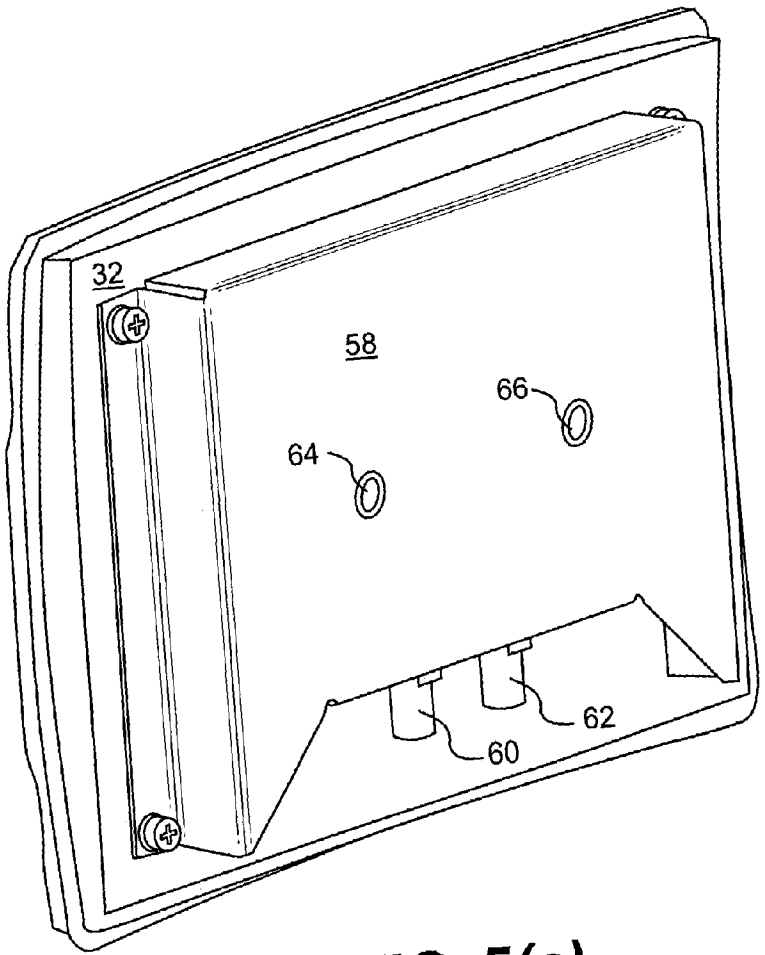
Figure 5D:
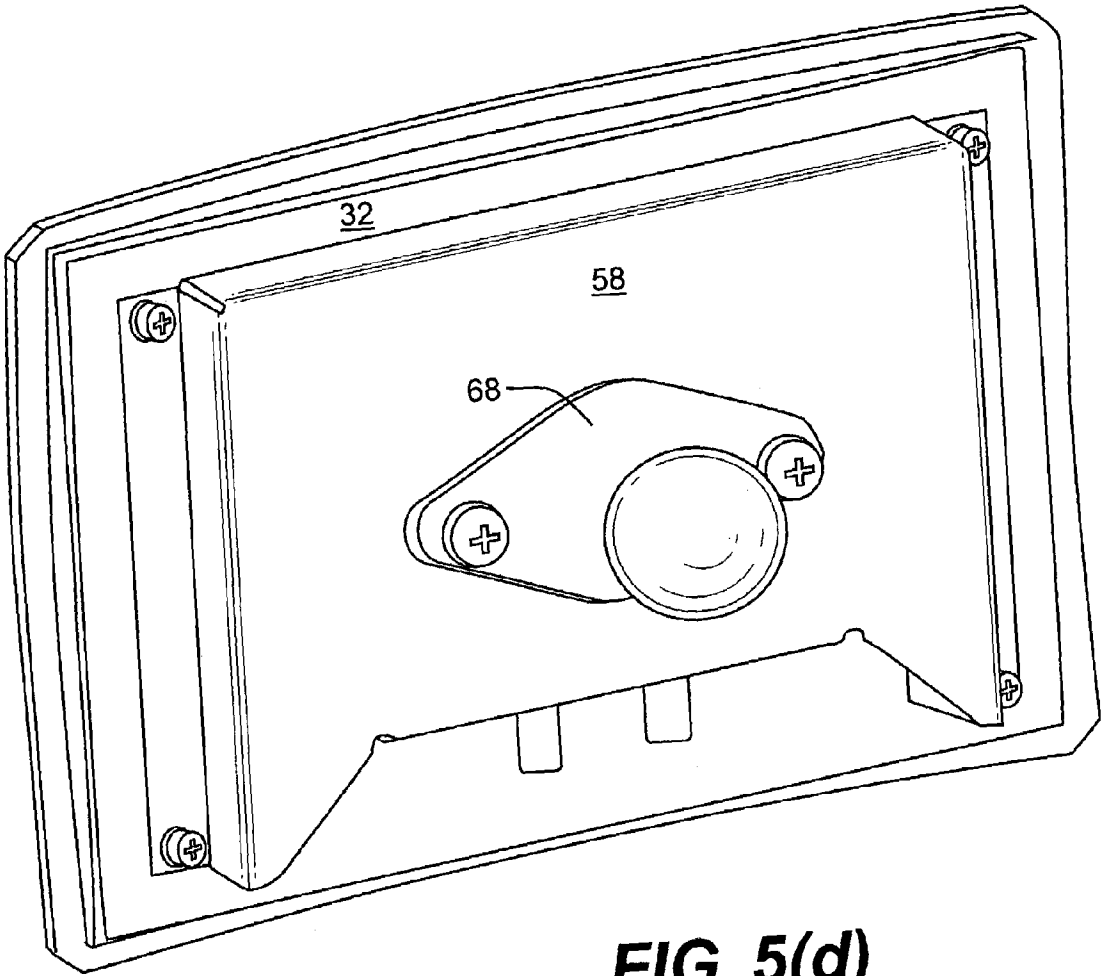
Figure 5E:
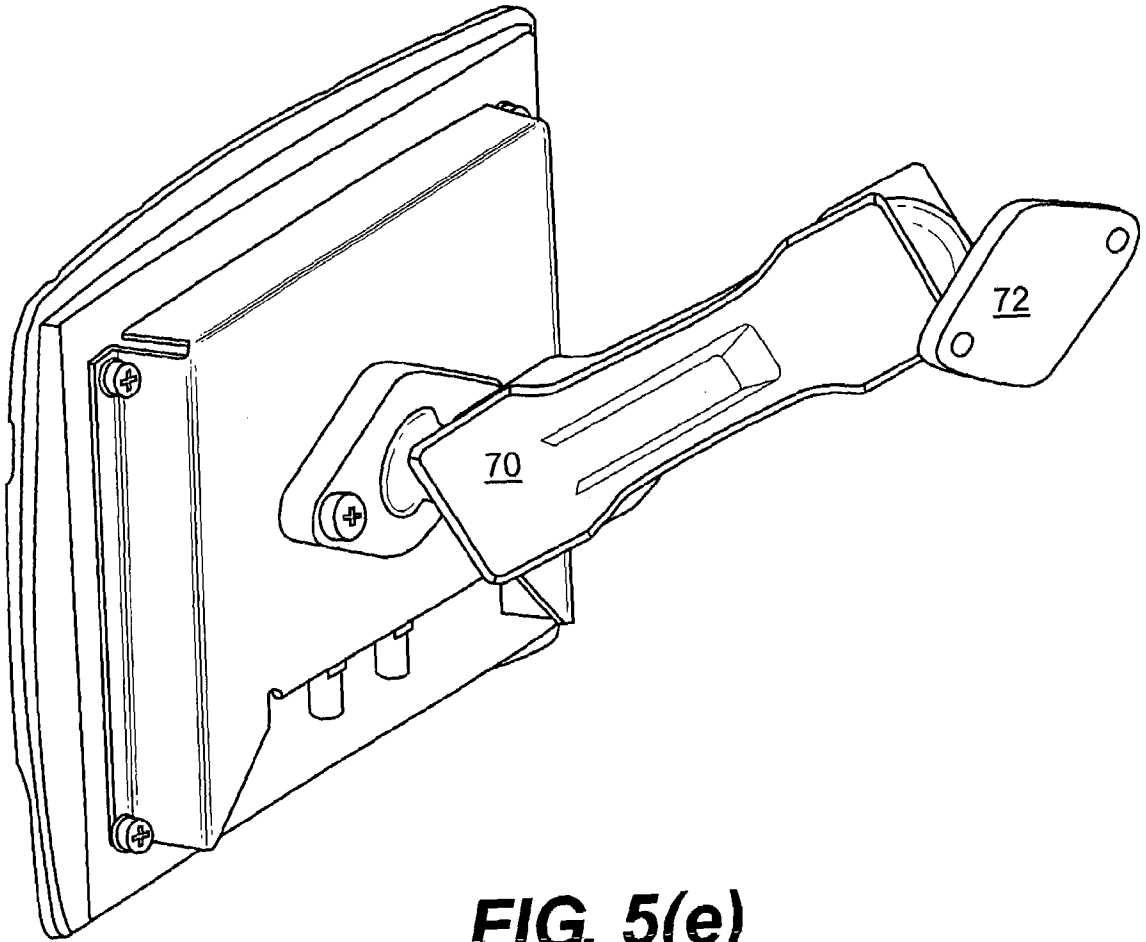
Figure 5F:
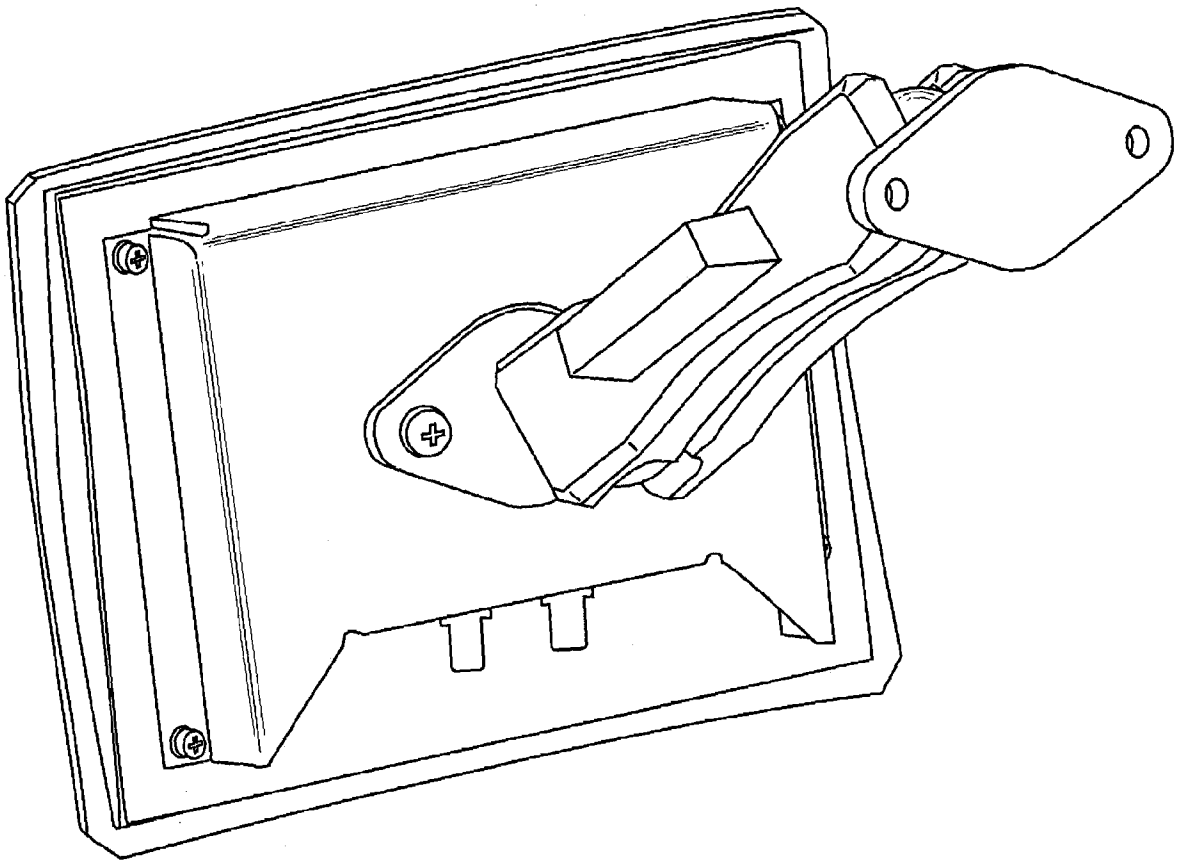
Figure 5G:
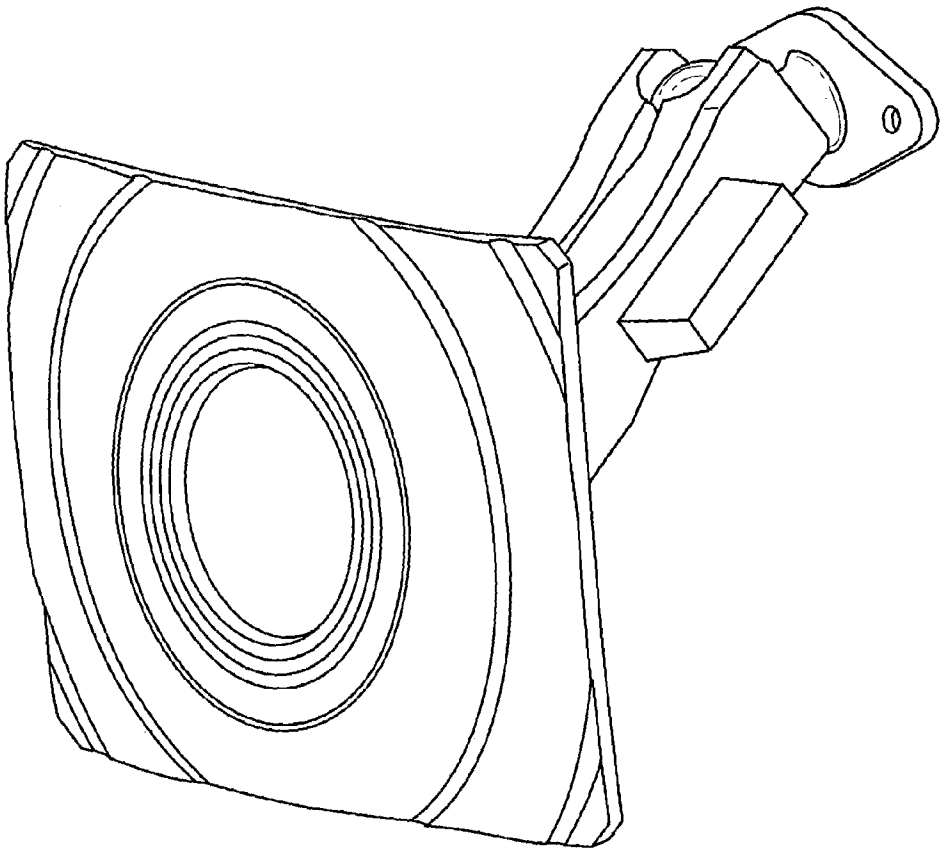
Figure 5H:
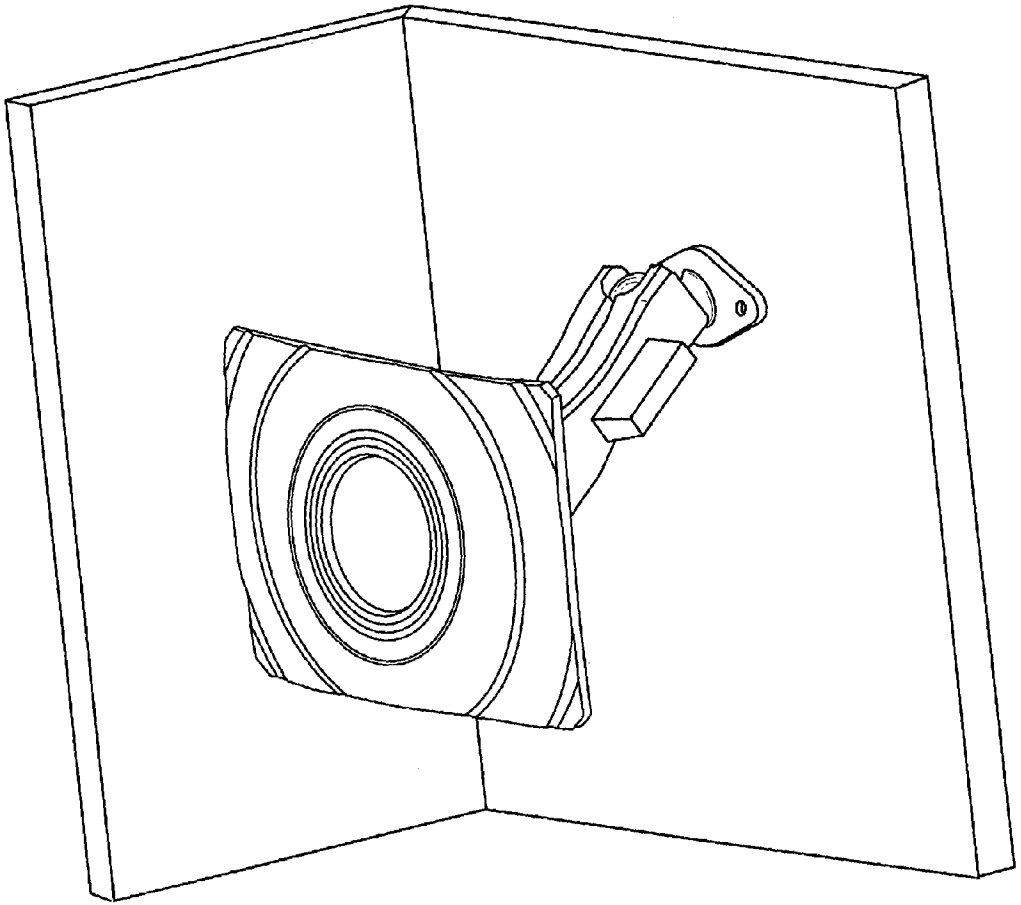
Figure 5I:
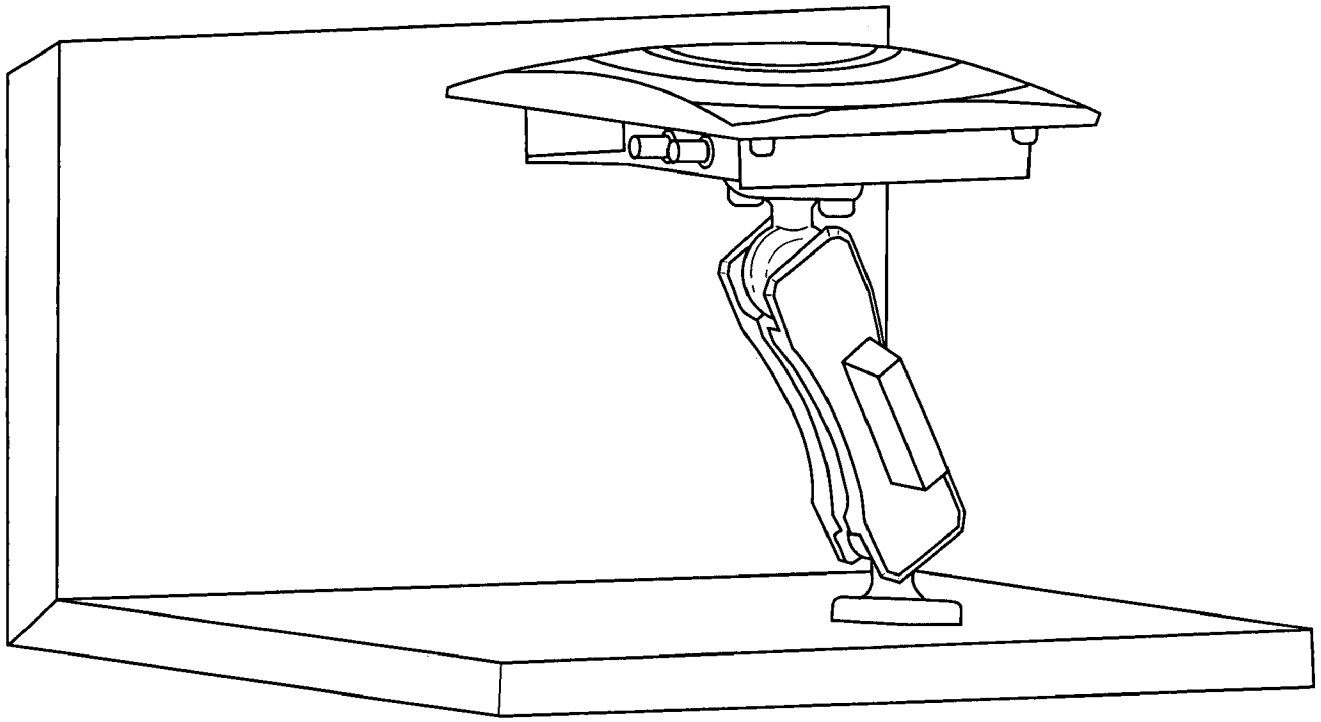
Figure 5J:
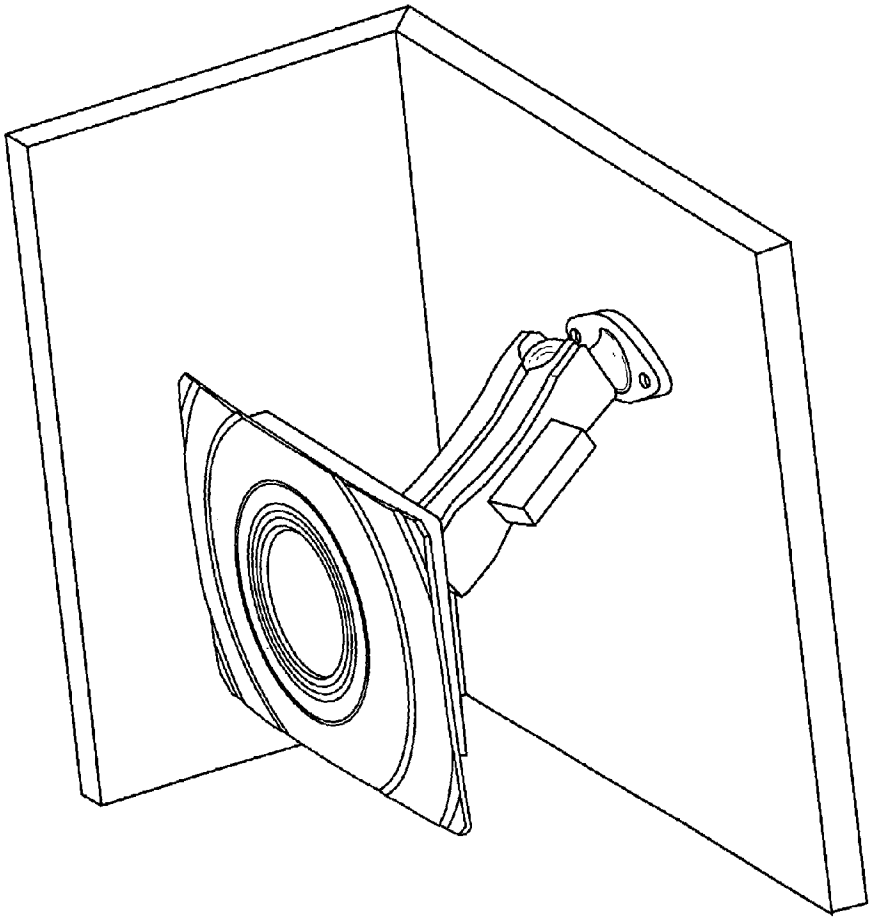
Figure 6A:
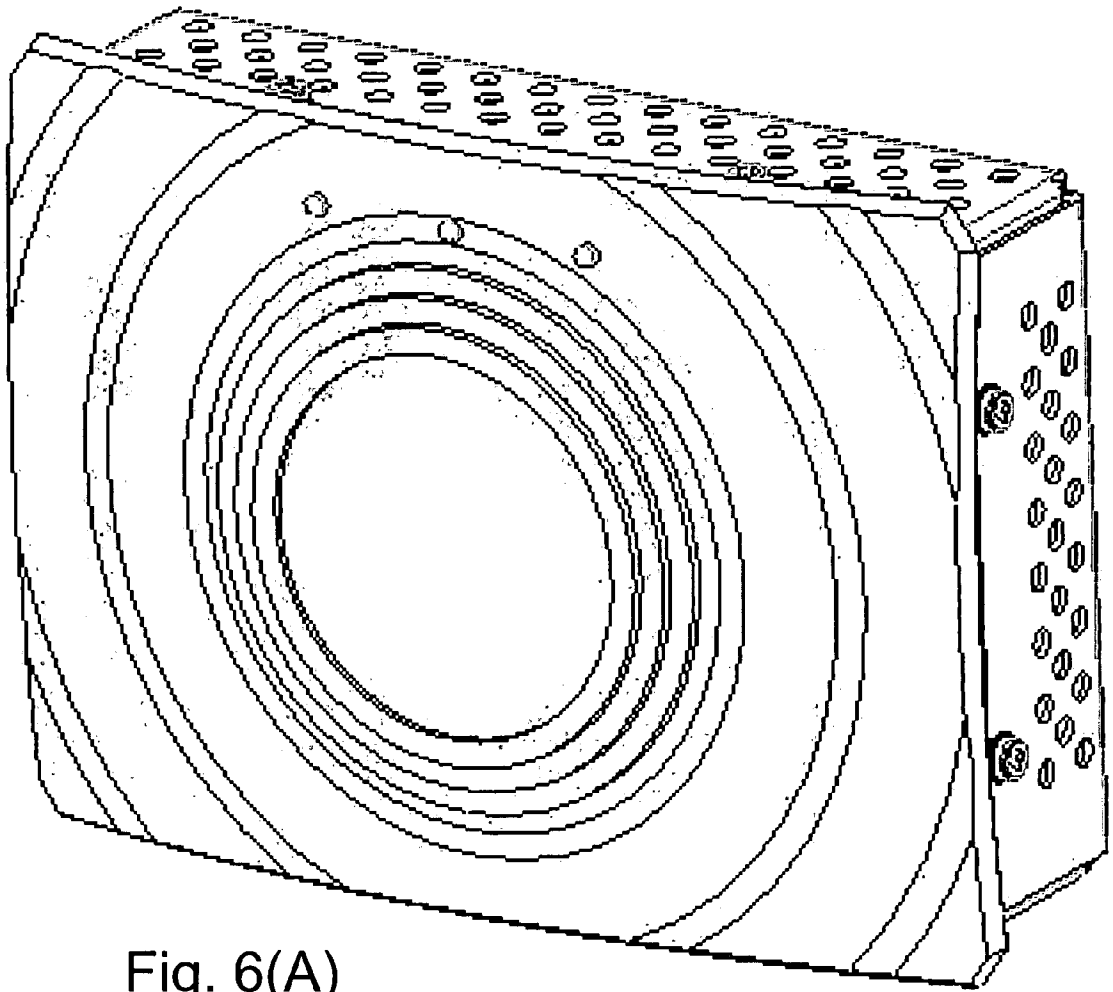
Figure 6B:
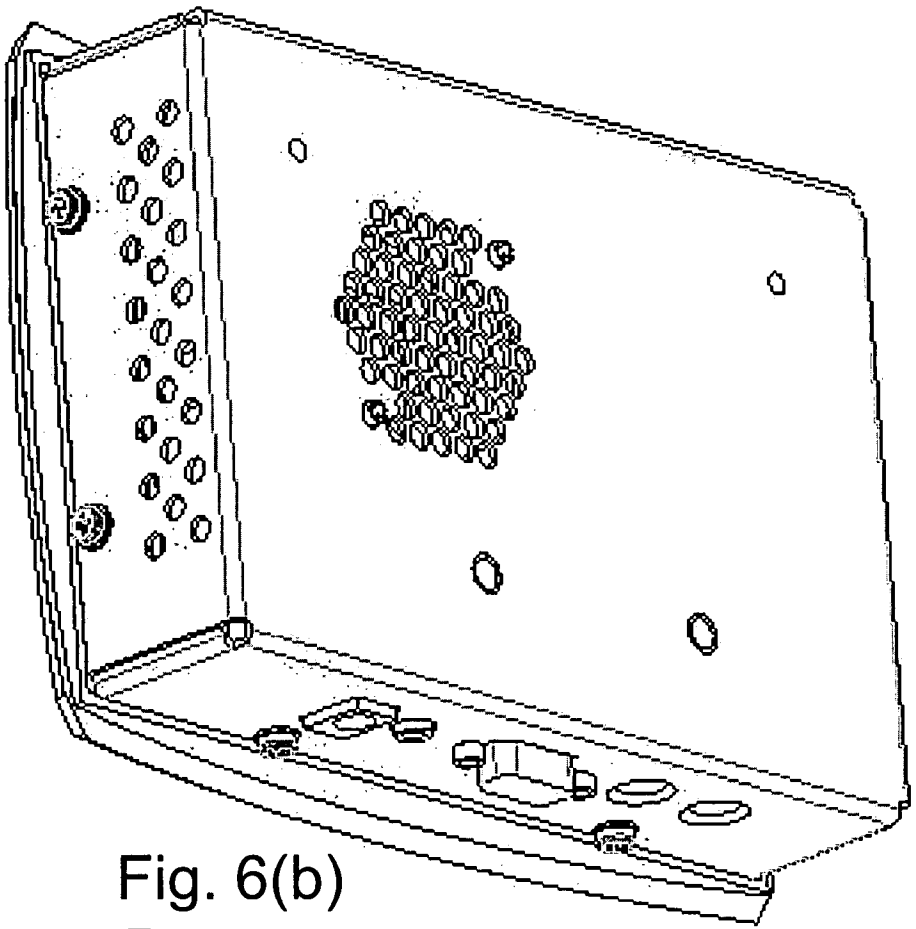
Figure 6C:
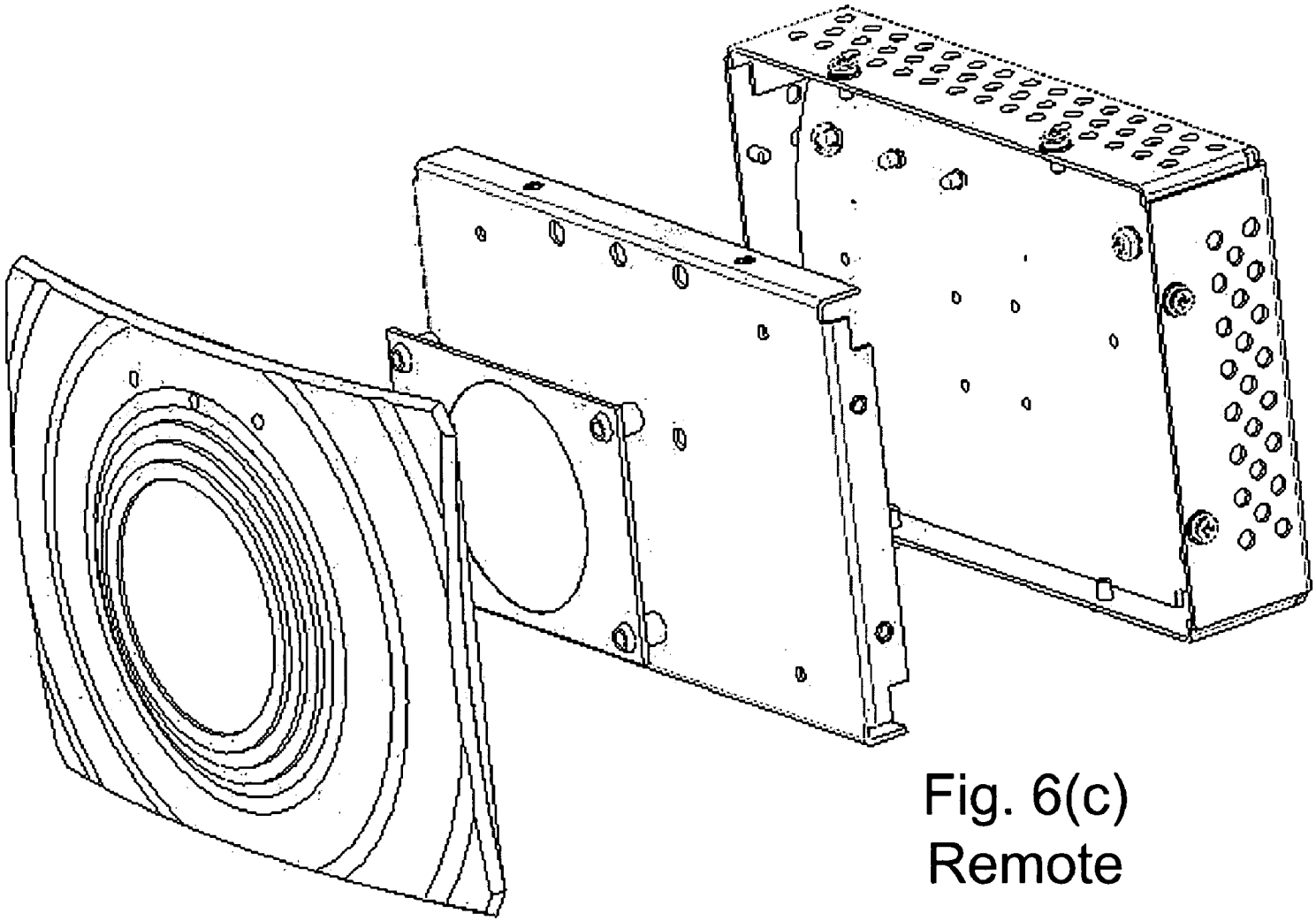
Figure 6D:
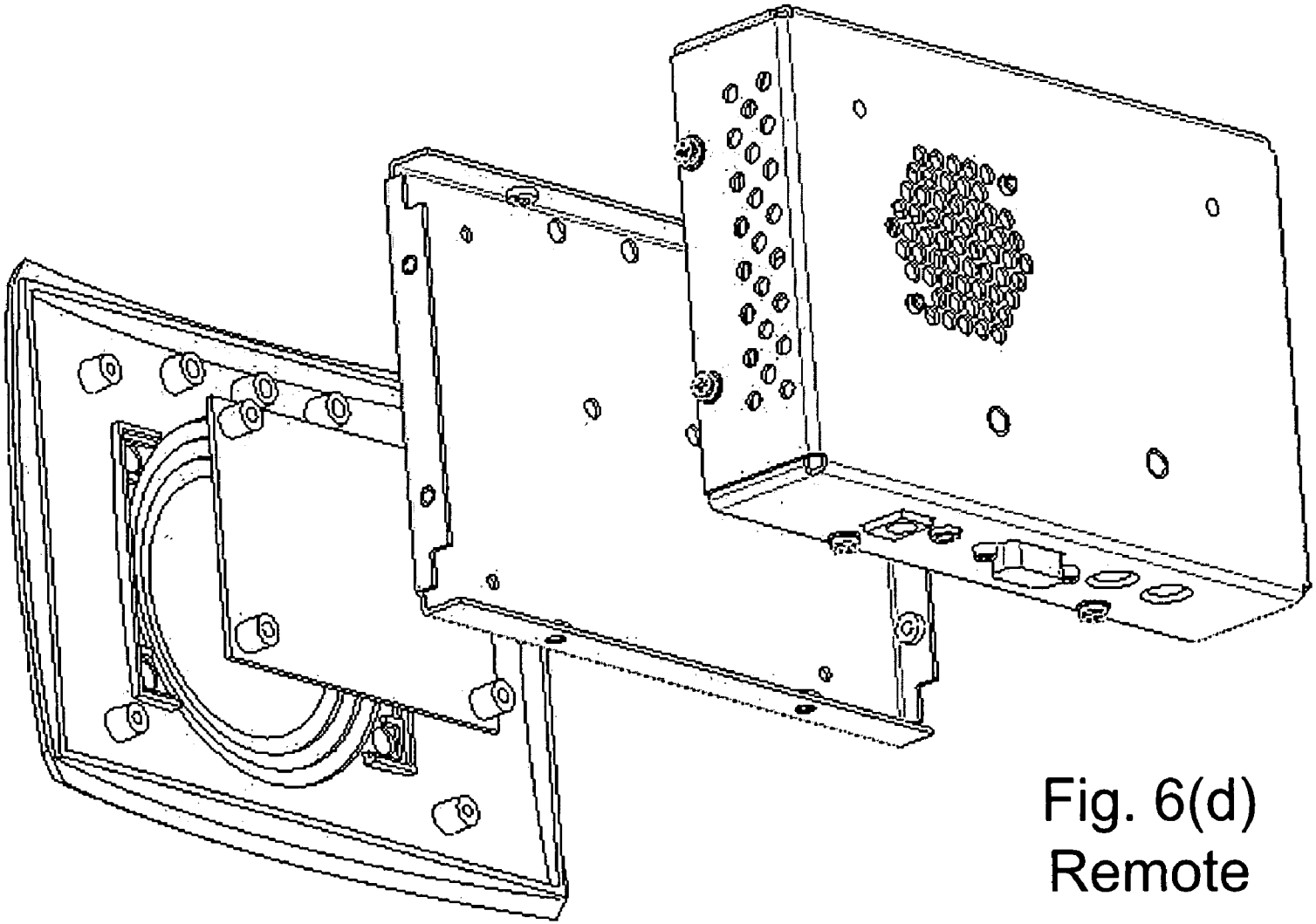
Figure 6G:
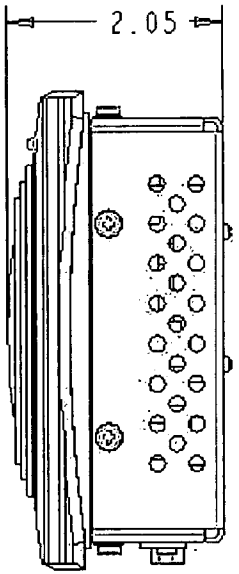
Figure 6E:
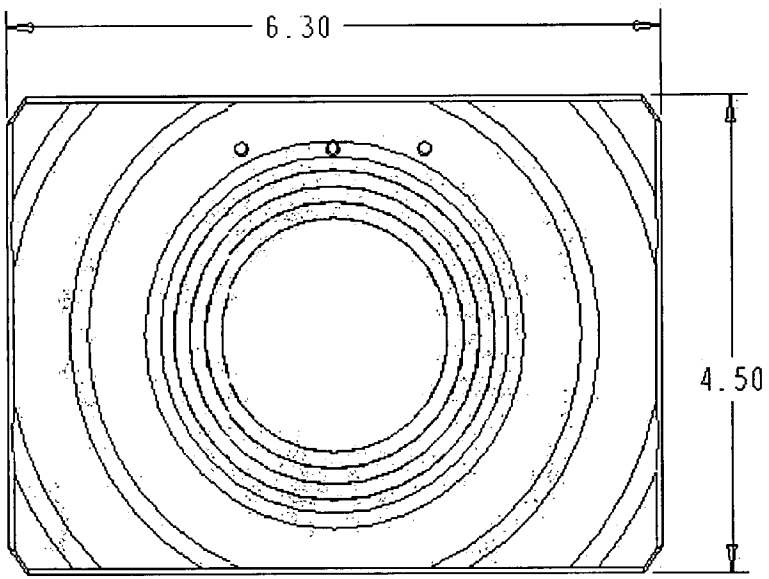
Figure 6F:
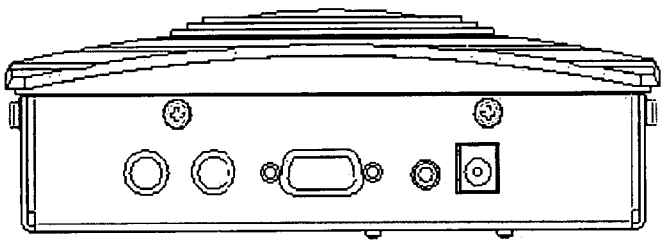
Figure 6H:
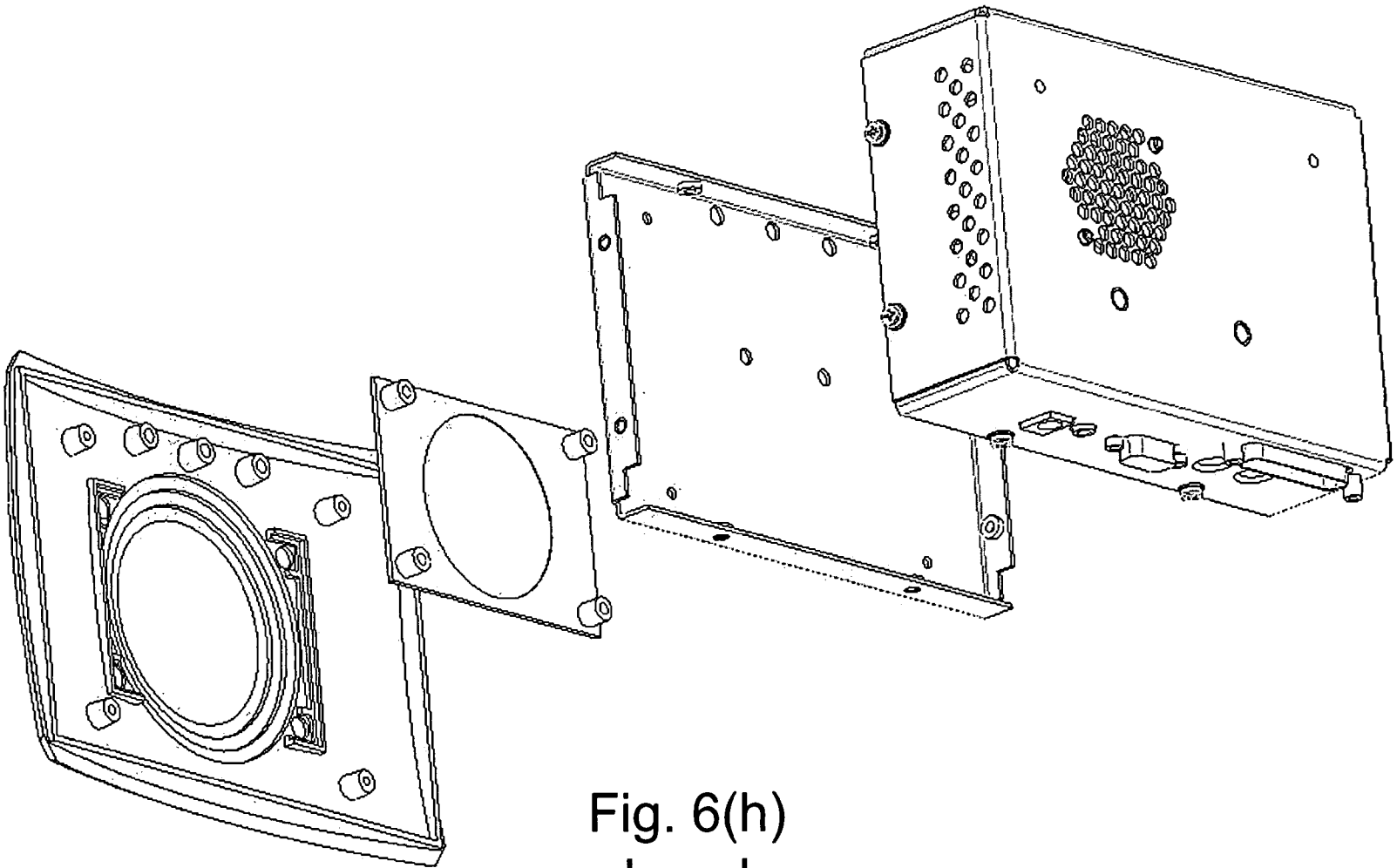
Figure 6J:
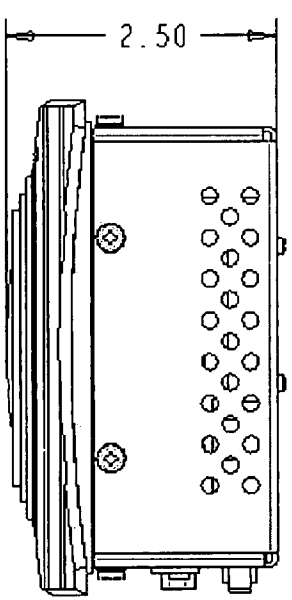
Figure 6I:
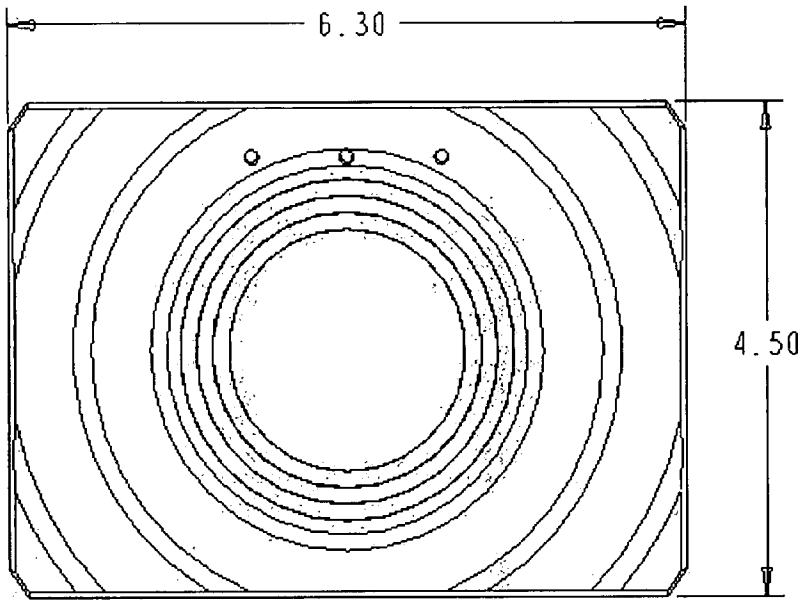
Figure 6K:
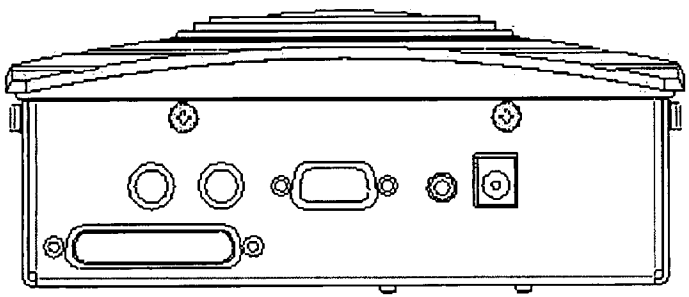
Figure 6M:
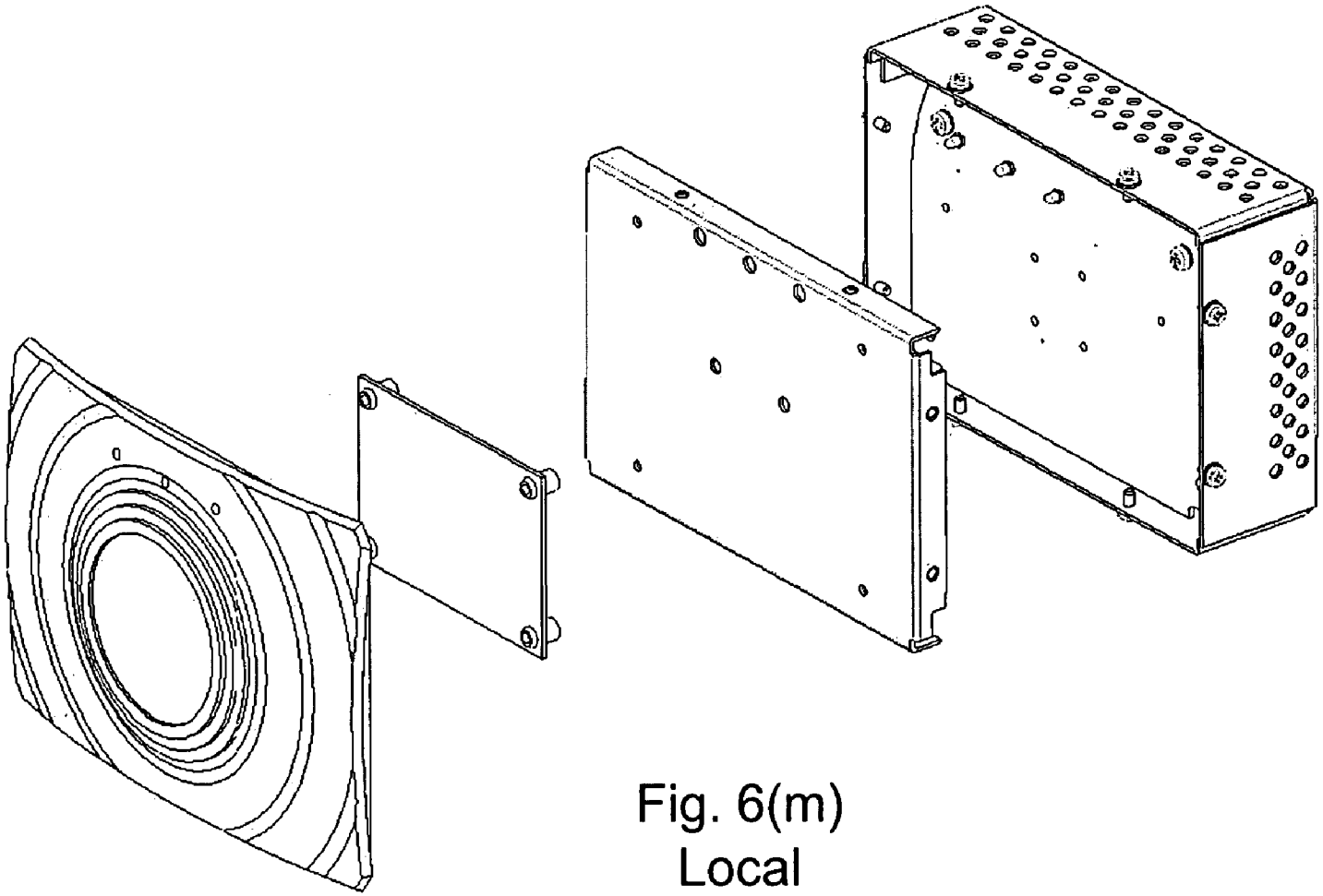
Figure 6N:
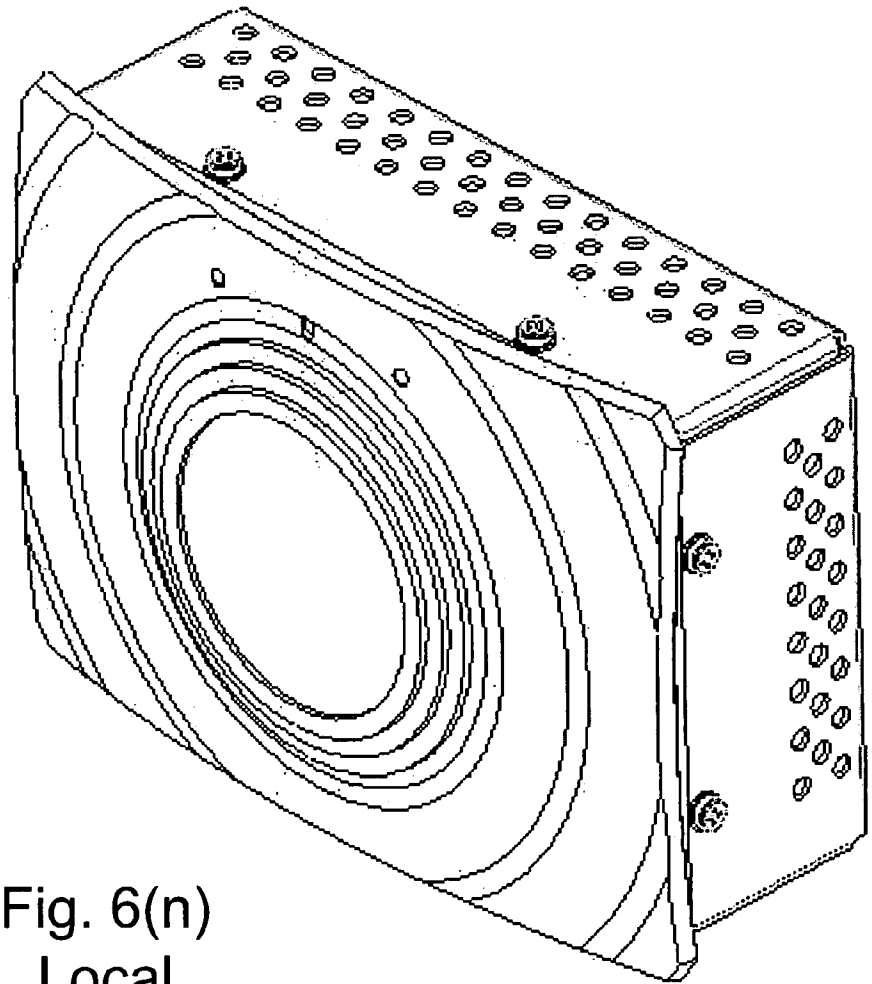

The gain of the antenna is preferably at least 6 dBi and cover all the uni-bands of 802.11a, approximately 5.1 GHz to 5.9 GHz. FIGS. 4(*a*) and 4(*b*) show results of operating the antenna at 5.1 GHz and 5.9 GHz frequencies, respectively.

In presently preferred embodiments of the invention, the circularly polarized directional antenna has an average beam width of about 70 degrees making it fairly practical to use for long distance transmission. The antenna's bandwidth covers more than the bandwidth actually used, keeping a very linear plane rotation. The antenna achieves high radiant efficiency due to its low-loss compensating network designed as part of the antenna elements to have a frequency dependant linear rotation function.

The four-arm spiral uses two low cost, independent, wideband matched power dividers for vertical and horizontal polarization directivity balancing. The two power dividers provide a choice of polarizations for a non-symmetric preformed beam width permitting the radios to select the best-fit polarization for transmitting and receiving data.

The conductor physical length of each arm of the antenna planer structure is preferably two wavelengths (of the desired bandwidth). The wavelength center is optimized for best impedance match in the desired bandwidth.

In preferred embodiments, a finite ground plane is used to keep backward reflections and side lobes at minimum for best antenna efficiency and desired beam width angle. FIGS. 4(*a*)–4(*b*) show plots of desired beam width for lower and upper uni-band frequencies. The height of the ground plane to the bottom surface of the dielectric material under the conducting arms surfaces, and the center of the wavelength yield high antenna gain, beam angle, and antenna efficiency. In presently preferred embodiments the distance between the antenna and the ground plane is about 0.25 inches. Other embodiments used spacing of up to about 0.5 inches. This particular structure configuration also allows control of the beam angle by changing the height distance of the ground plane to the bottom surface of the dielectric material under the conducting arms surfaces with small effects on antenna efficiency and antenna matching due to its ultra broad band natural design topology. In other words, the spacing between the board and ground plane can be used to adjust the beam width (i.e., gain) and efficiency.

Packaging

One skilled in the art will realize that the spiral antenna of the present invention may be packaged in many ways. However, one packaging of the antenna is described herein with reference to FIGS. 5(*a*)–5(*j*).

FIG. 5(*a*) shows the back view of an antenna mount 32, preferably formed of a light-weight molded plastic. FIG. 5(*b*) shows a front view of the antenna mount 32. With reference to FIG. 1, in this embodiment the PCB (substrate) 12 has four holes 34, 36, 38, 40 in the four corners thereof. These holes allow the board to be positioned over four corresponding pins 42, 44, 46, 48 formed on a portion of the antenna mount 32. The PCB board 12 is mounted with the pins 42, 44, 46, 48 in the corresponding holes 34, 36, 38, 40 of the board such that the spiral antenna faces the front of the mount 32, and the connector and ground pins 20, 22, 24, 26, 28, 30, face the rear so that they may be connected with cables and or other circuitry.

The back side of mount 32 has four pins 50, 52, 54, 56, one in each of the outer four corners thereof. These pins hold in place a rear cover 58 which may be secured to the mount 32 by four screws. The rear cover 58 may house circuitry and provides connectors 60, 62 to the antenna 10 housed on the mount 32.

The rear cover 58 has two holes 64, 66 therein. Preferably these holes are threaded to enable connection of a ball joint 68 thereto, as shown in FIG. 5(*d*). The ball joint 68 may be connected to an arm 70, itself having a ball joint 72 connected to another end thereof (as shown in FIGS. 5(*e*)–5(*g*)). The entire construct housing the antenna may then be mounted on a wall, ceiling or other appropriate surface, as shown, e.g., in FIGS. 5(*h*)–5(*j*). One skilled in the art will realize that in this manner the antenna may be positioned and aimed in a particular direction.

In some preferred embodiments of the present invention, the PCB 12 has dimensions 2.25 inches by 3.25 inches, and the holes 34, 36, 38, 40 are 0.156 inches in diameter, centered 0.200 inches from the edges of the board.

This structure, with its circular polarization for linear propagation used with an 802.11a communication link, allows minimal distortion, high efficiency and yields longer transmission distances.

The structure uses two coax cables. Each coax cable is used for two functions: independent vertical and horizontal feeds; and as a 180 degree phase shifted broad band transformer to feed each arm of the antenna.

Another packaging embodiment is shown in FIGS. 6(*a*)–6(*n*), where FIGS. 6(*a*)–6(*g*) show the packaging of a remote-side unit, and FIGS. 6(*h*)–6(*n*) show the packaging of a local-side unit.

Operation in a Wireless KVM System

Figure 7:
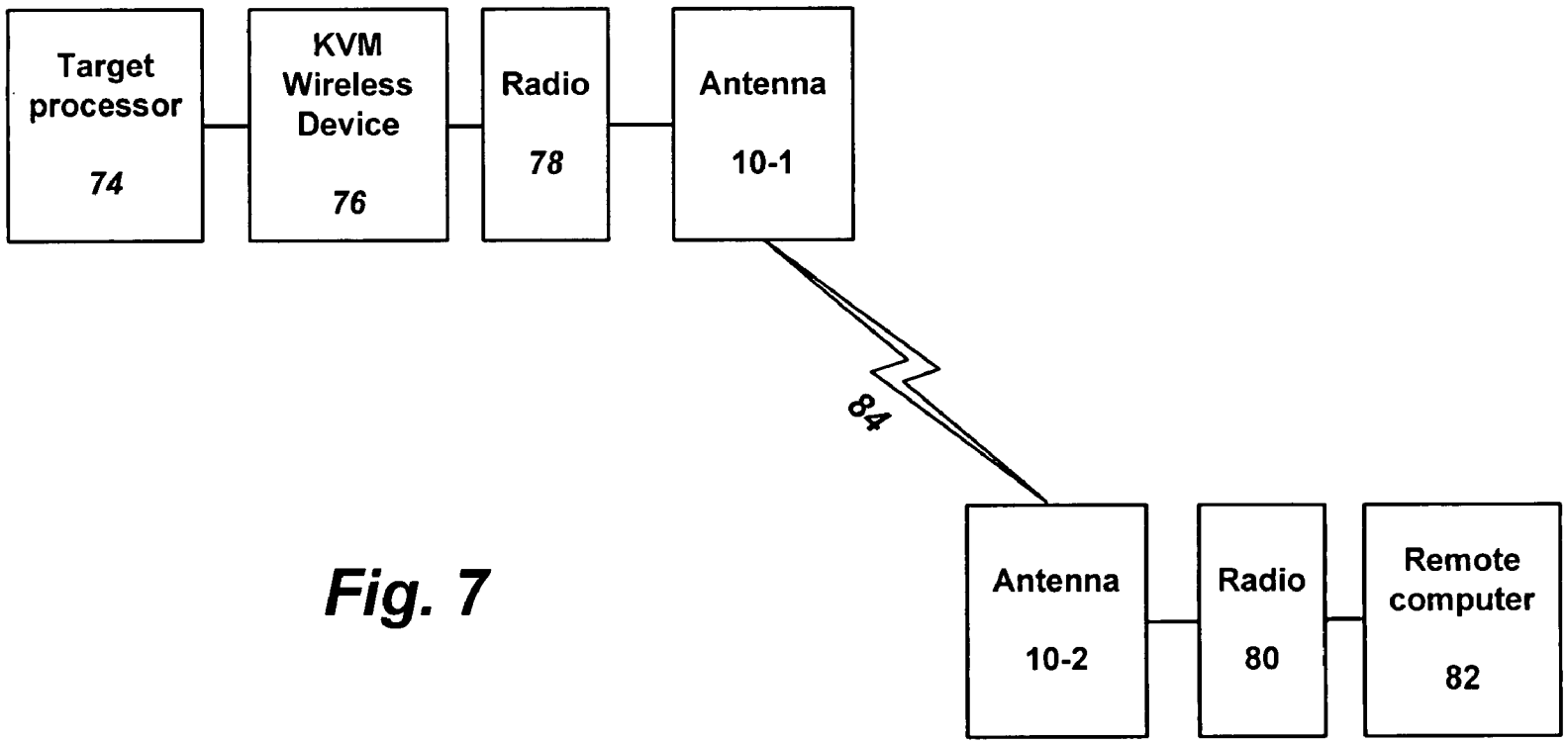
FIG. 7 depicts the operation of the present invention in a wireless KVM system.

FIG. 7 depicts the use and operation of an antenna according to the present invention in a wireless KVM system. A target processor 74 is connected to a KVM wireless device 76 which is connected to a radio 78. The radio has an antenna 10-1 connected thereto. A remote computer 82 is connected to a radio 80 which has an antenna 10-2 connected thereto. Either or both of the antennas 10-1, 10-2 may be antennas according to embodiments of the present invention. As noted earlier, the target processor 74 may be any type processor or collection of processors, including servers, processors in appliances such as ATM machines, kiosks and the like. In operation, the remote computer 82 connects via radio link 84 to the target processor 74. The remote computer 82 may then access and/or control the target processor 74, providing keyboard and mouse signals thereto and receiving keyboard, video and mouse signals therefrom. In some cases the target processor may not have a keyboard, mouse or display attached thereto (e.g., in the case of an embedded processor or a server or a processor in a device such as an ATM). In such cases, the processor would provide video signals to the remote computer 82 and receive KVM signals therefrom.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An antenna apparatus comprising:

a circuit board;

a spiral metallic pattern formed on a portion of the circuit board on a first side thereof, the spiral pattern being formed of at least four arms, each arm having a contact location; and at least two signal connectors and at least four ground connectors attached to a second side of said circuit board, wherein at least two of the arms are each electrically connected to a respective signal connector and wherein a different two or more of the arms are each electrically connected to at least two of the ground connectors, wherein the circuit board is mounted in a housing constructed and adapted to direct the antenna in a specific direction.

2. An antenna apparatus as in claim 1 wherein each arm has a contact location near a center of the spiral.

3. An antenna as in claim 1 further comprising a finite ground plane.

4. An apparatus as in claim 3 wherein said finite ground plane is constructed and adapted to minimize backward reflections and side lobes.

5. An apparatus as in claim 1 wherein:

said at least two signal connectors are electrically connected to the ones of the spiral arms at the contact locations thereof, said signal connectors being connected to said arms via holes in said circuit board.

6. An apparatus as in claim 5 wherein each of said holes is substantially covered on said first side of said circuit board by the contact location of one of said at least four arms.

7. An apparatus as in claim 1 wherein the gain of the antenna is preferably at least 6 dBi and covers the uni-bands of 802.11a.

8. An apparatus as in claim 1 wherein the apparatus forms a circularly polarized directional antenna with an average beam width of about 70 degrees.

9. The apparatus of claim 1 wherein a conductor physical length of each arm is preferably two wavelengths of a desired bandwidth.

10. An antenna apparatus comprising:

a spiral metallic pattern formed on a portion of a circuit board on a first side thereof, the spiral pattern being formed of at least four arms, each arm having a contact location; and at least two signal connectors and at least four ground connectors, wherein at least two of the arms are each electrically connected to a respective signal connector and wherein a different two or more of the arms are each electrically connected to at least two of the ground connectors.

11. An apparatus as in claim 10 wherein the circuit board is mounted in a housing constructed and adapted to direct the antenna in a specific direction.

12. An apparatus as in claim 10 further comprising a finite ground plane.

13. An apparatus as in claim 12 wherein said finite ground plane is constructed and adapted to minimize backward reflections and side lobes.

14. An apparatus as in claim 10 wherein said at least two signal connectors and said at least four ground connectors are attached to a second side of said circuit board, and are electrically connected to the ones of the spiral arms at the contact locations thereof, said electrical connections to said arms being via holes in said circuit board.

15. The apparatus of claim 10 wherein a conductor physical length of each arm is preferably two wavelengths of a desired bandwidth.

16. An antenna comprising:

a spiral metallic pattern formed on a portion of a circuit board on a first side thereof, the spiral pattern being formed of a plurality of arms, each arm having a contact location; and a plurality of signal connectors and a plurality of ground connectors, wherein at least two of the arms are electrically connected to a respective signal connector and wherein a different two of the arms are each electrically connected to two of the ground connectors, wherein the circuit board is mounted in a housing constructed and adapted to direct the antenna in a specific direction.

17. An antenna as in claim 16 wherein each arm has a contact location near the center of the spiral.

18. An antenna as in claim 16 further comprising a finite ground plane.

19. An apparatus as in claim 18 wherein said finite ground plane is constructed and adapted to minimize backward reflections and side lobes.

20. An apparatus as in claim 16, wherein:

said plurality of signal connectors and said plurality of ground connectors are on a second side of said circuit board and are electrically connected to said arms via holes in said circuit board.

* * * * *